US009115655B2

(12) United States Patent
Rayl

(10) Patent No.: US 9,115,655 B2
(45) Date of Patent: Aug. 25, 2015

(54) CYLINDER PRESSURE PARAMETER CORRECTION SYSTEMS AND METHODS

(76) Inventor: Allen B. Rayl, Waterford, MI (US)

( * ) Notice: Subject to any disclaimer, the term of this patent is extended or adjusted under 35 U.S.C. 154(b) by 879 days.

(21) Appl. No.: 13/094,273

(22) Filed: Apr. 26, 2011

(65) Prior Publication Data

US 2012/0277970 A1 Nov. 1, 2012

(51) Int. Cl.
*F02D 35/02* (2006.01)
*F02D 41/00* (2006.01)

(52) U.S. Cl.
CPC ..... *F02D 35/023* (2013.01); *F02D 35/028* (2013.01); *F02D 41/009* (2013.01)

(58) Field of Classification Search
CPC .... F02D 35/023; F02D 41/009; F02D 35/028
USPC ..... 123/435, 436; 701/102, 111
See application file for complete search history.

(56) References Cited

U.S. PATENT DOCUMENTS

| | | | | |
|---|---|---|---|---|
| 4,466,405 | A | 8/1984 | Hattori et al. | |
| 5,107,814 | A | 4/1992 | Nishiyama et al. | |
| 5,749,334 | A | 5/1998 | Oda et al. | |
| 6,101,998 | A * | 8/2000 | Tamura et al. | 123/295 |
| 6,681,739 | B2 | 1/2004 | Mamiya et al. | |
| 6,684,151 | B1 * | 1/2004 | Ring | 701/110 |
| 6,792,924 | B2 | 9/2004 | Aoyama et al. | |
| 6,971,350 | B2 | 12/2005 | Akasaka et al. | |
| 7,024,304 | B2 | 4/2006 | Fukasawa et al. | |
| 7,124,020 | B2 | 10/2006 | Vermonet et al. | |
| 7,506,535 | B2 | 3/2009 | Kang | |
| 7,761,223 | B2 | 7/2010 | Wang et al. | |
| 7,848,910 | B2 * | 12/2010 | Schantl et al. | 703/6 |
| 8,033,267 | B2 | 10/2011 | Nakagawa et al. | |
| 8,600,644 | B2 * | 12/2013 | Verner et al. | 701/102 |
| 2005/0022789 | A1 * | 2/2005 | Palma et al. | 123/435 |
| 2006/0293829 | A1 * | 12/2006 | Cornwell et al. | 701/114 |
| 2007/0056560 | A1 * | 3/2007 | Trask et al. | 123/435 |
| 2007/0288213 | A1 * | 12/2007 | Schantl et al. | 703/8 |
| 2008/0201060 | A1 * | 8/2008 | Nagai | 701/103 |
| 2009/0007564 | A1 | 1/2009 | Suzuki et al. | |
| 2011/0303190 | A1 | 12/2011 | Yasuda | |
| 2012/0277972 | A1 | 11/2012 | Rayl | |

FOREIGN PATENT DOCUMENTS

CN 1181800 A 5/1998

OTHER PUBLICATIONS

U.S. Appl. No. 13/113,496, filed May 23, 2011, Verner.

* cited by examiner

*Primary Examiner* — Hieu T Vo
*Assistant Examiner* — Sherman Manley

(57) ABSTRACT

A system includes a net mean effective pressure (NMEP) error module, a correction determination module, a mean effective pressure (MEP) correction module, and an actuator control module. The NMEP error module determines an NMEP error for a combustion cycle of a cylinder based on an expected NMEP for the combustion cycle, a measured NMEP for the combustion cycle, and a difference between an expected change in an engine speed for the combustion cycle and a measured change in the engine speed for the combustion cycle. The correction determination module determines an offset correction and a slope correction based on the NMEP error. The MEP correction module that generates a corrected NMEP for the combustion cycle based on the measured NMEP, the offset correction, and the slope correction. The actuator control module controls an engine operating parameter based on the corrected NMEP.

20 Claims, 3 Drawing Sheets

CYLINDER PRESSURE PARAMETER CORRECTION SYSTEMS AND METHODS

FIELD

The present disclosure relates to internal combustion engines and more particularly to cylinder pressure control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Air is drawn into an engine through an intake manifold. A throttle valve controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, injection of the fuel or spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other inputs. The driver inputs may include, for example, accelerator pedal position, brake pedal position, and/or one or more other suitable driver inputs. The other inputs may include, for example, cylinder pressure measured using a cylinder pressure sensor, one or more variables determined based on the measured cylinder pressure, and/or one or more other suitable values.

SUMMARY

A system includes a net mean effective pressure (NMEP) error module, a correction determination module, a mean effective pressure (MEP) correction module, and an actuator control module. The NMEP error module determines an NMEP error for a combustion cycle of a cylinder based on an expected NMEP for the combustion cycle, a measured NMEP for the combustion cycle, and a difference between an expected change in an engine speed for the combustion cycle and a measured change in the engine speed for the combustion cycle. The correction determination module determines an offset correction and a slope correction based on the NMEP error. The MEP correction module that generates a corrected NMEP for the combustion cycle based on the measured NMEP, the offset correction, and the slope correction. The actuator control module controls an engine operating parameter based on the corrected NMEP.

A method includes: determining a net mean effective pressure (NMEP) error for a combustion cycle of a cylinder based on an expected NMEP for the combustion cycle, a measured NMEP for the combustion cycle, and a difference between an expected change in an engine speed for the combustion cycle and a measured change in the engine speed for the combustion cycle; determining an offset correction and a slope correction based on the NMEP error; generating a corrected NMEP for the combustion cycle based on the measured NMEP, the offset correction, and the slope correction; and controlling an engine operating parameter based on the corrected NMEP.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
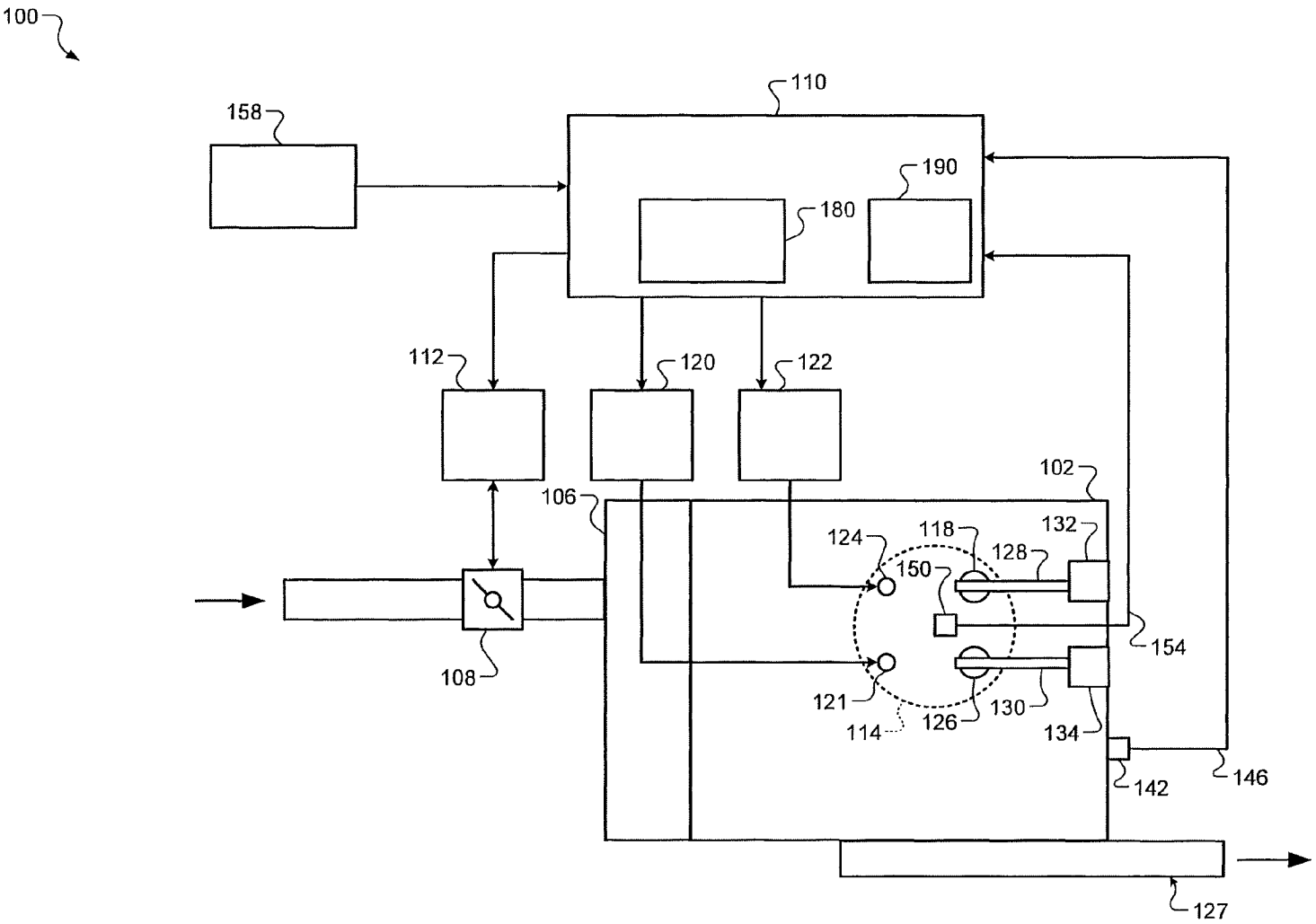
FIG. 1 is a functional block diagram of an example engine system according to the present disclosure.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

A cylinder pressure sensor measures pressure within a cylinder of an engine and generates a cylinder pressure signal based on the pressure within the cylinder. An engine control module (ECM) generates various cylinder pressure parameters based on the cylinder pressure signal. For example only, the ECM may generate one or more mean effective pressures (MEPs) based on the cylinder pressure signal, such as an indicated mean effective pressure (IMEP), a net mean effective pressure (NMEP), a brake mean effective pressure (BMEP), a loss in the IMEP associated with pumping losses (PMEP), and a loss in the IMEP associated with friction (FMEP). The ECM may selectively control or adjust one or more engine operating parameters based on one or more of the cylinder pressure parameters.

Under some circumstances, however, the relative error of the cylinder pressure signal relative to the magnitude of the cylinder pressure signal may increase. For example only, the relative error in the cylinder pressure signal may increase as the cylinder pressure signal decreases toward a lower boundary of a range of the cylinder pressure signal where the amount of error in the cylinder pressure signal increases. An increase in the relative error of the cylinder pressure signal may cause an error in a cylinder pressure parameter to increase.

The ECM of the present disclosure generates an offset correction and a slope correction for one or more of the cylinder pressure parameters. The ECM generates corrected versions of the cylinder pressure parameters based on the offset correction and the slope correction. For example only, the ECM generates a corrected IMEP based on a measured IMEP, the offset correction, and the slope correction. Correcting one or more of the cylinder pressure parameters based on the offset and slope corrections may allow the ECM to better balance the cylinders of the engine to decrease engine noise and vibration.

Referring now to FIG. 1, a functional block diagram of an example engine system 100 is presented. The engine system 100 includes an engine 102 that combusts an air/fuel mixture to produce drive torque for a vehicle. While the engine 102 will be discussed as a spark ignition direct injection (SIDI) engine, the engine 102 may include another suitable type of engine, such as a homogenous charge compression ignition (HCCI) engine. One or more electric motors and/or motor generator units (MGUs) may be used with the engine 102.

Air is drawn into an intake manifold 106 through a throttle valve 108. The throttle valve 108 varies airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through one or more intake valves, such as intake valve 118.

The ECM 110 controls a fuel actuator module 120, and the fuel actuator module 120 controls opening of a fuel injector 121. The fuel injector 121 injects fuel into the cylinder 114. Fuel is provided to the fuel injector 121 by a low pressure fuel pump and a high pressure fuel pump (not shown). The low pressure fuel pump draws fuel from a fuel tank and provides fuel at low pressures to the high pressure fuel pump. The high pressure fuel pump selectively further pressurizes the fuel, for example, for direct injection into the cylinders of the engine 102.

The injected fuel mixes with air and creates an air/fuel mixture in the cylinder 114. A piston (not shown) within the cylinder 114 compresses the air/fuel mixture. Based upon a signal from the ECM 110, a spark actuator module 122 energizes a spark plug 124 in the cylinder 114. Spark generated by the spark plug 124 ignites the air/fuel mixture. The timing of the spark may be specified relative to the time when the piston is at its topmost position, referred to as top dead center (TDC).

The combustion of the air/fuel mixture drives the piston down, and the piston drives rotation of a crankshaft (not shown). After reaching a bottom most position, referred to as bottom dead center (BDC), the piston begins moving up again and expels the byproducts of combustion through one or more exhaust valves, such as exhaust valve 126. The byproducts of combustion are exhausted from the vehicle via an exhaust system 127.

One combustion cycle, from the standpoint of the cylinder 114, may include two revolutions of the crankshaft (i.e., 720° of crankshaft rotation). One combustion cycle for the cylinder 114 includes four phases: an intake phase; a compression phase; an expansion phase; and an exhaust phase. For example only, the piston lowers toward the BDC position and air is drawn into the cylinder 114 during the intake phase. The piston rises toward the TDC position and compresses the contents of the cylinder 114 during the compression phase. Fuel may be injected into the cylinder 114 during the compression phase. Fuel injection may also occur during the expansion phase. Combustion drives the piston toward the BDC position during the expansion phase. The piston rises toward the TDC position to expel the resulting exhaust gas from the cylinder 114 during the exhaust phase. One engine cycle may refer to the period associated with each of the cylinders undergoing one complete combustion cycle.

The intake valve 118 may be controlled by an intake camshaft 128, while the exhaust valve 126 may be controlled by an exhaust camshaft 130. In various implementations, multiple intake camshafts may control multiple intake valves per cylinder and/or may control the intake valves of multiple banks of cylinders. Similarly, multiple exhaust camshafts may control multiple exhaust valves per cylinder and/or may control exhaust valves for multiple banks of cylinders. The time at which the intake valve 118 is opened may be varied with respect to the TDC position by an intake cam phaser 132. The time at which the exhaust valve 126 is opened may be varied with respect to the TDC position by an exhaust cam phaser 134. Fuel injection timing may also be specified relative to the position of the piston.

A crankshaft position sensor 142 monitors rotation of the crankshaft and generates a crankshaft position signal 146 based on the rotation of the crankshaft. For example only, the crankshaft position sensor 142 may include a variable reluctance (VR) sensor or another suitable type of crankshaft position sensor. The crankshaft position signal 146 may include a pulse train. A pulse may be generated in the crankshaft position signal 146 as a tooth of an N-toothed wheel (not shown) that rotates with the crankshaft passes the crankshaft position sensor 146. Accordingly, each pulse corresponds to an angular rotation of the crankshaft by an amount approximately equal to 360° divided by N teeth. The N-toothed wheel may also include a gap of one or more missing teeth, and the gap may be used as an indicator of one complete revolution of the crankshaft (i.e., 360° of crankshaft rotation).

A cylinder pressure sensor 150 measures pressure within the cylinder 114 and generates a cylinder pressure signal 154 based on the pressure. One or more other sensors 158 may also be provided. For example, the other sensors 158 may include a mass air flowrate (MAF) sensor, a manifold absolute pressure (MAP) sensor, an intake air temperature (IAT) sensor, a coolant temperature sensor, one or more camshaft position sensors, and/or one or more other suitable sensors.

The ECM 110 includes a pressure parameter correction module 180 that generates various cylinder pressure related parameters. The pressure parameter correction module 180 also generates offset and slope corrections for the cylinder pressure related parameters to account for error in the cylinder pressure signal 154. The pressure parameter correction module 180 generates corrected values of the cylinder pressure related parameters based on the cylinder pressure related parameters, respectively, and the offset and slope corrections. An actuator control module 190 may control one or more engine actuators based on one or more of the corrected values. For example only, the actuator control module 190 may control fuel injection (e.g., timing and amount), throttle opening, spark timing, intake and/or exhaust valve lift and/or duration, boost of a boost device (e.g., a turbocharger), exhaust gas recirculation (EGR) opening, and/or one or more other suitable engine operating parameters.

Figure 2:
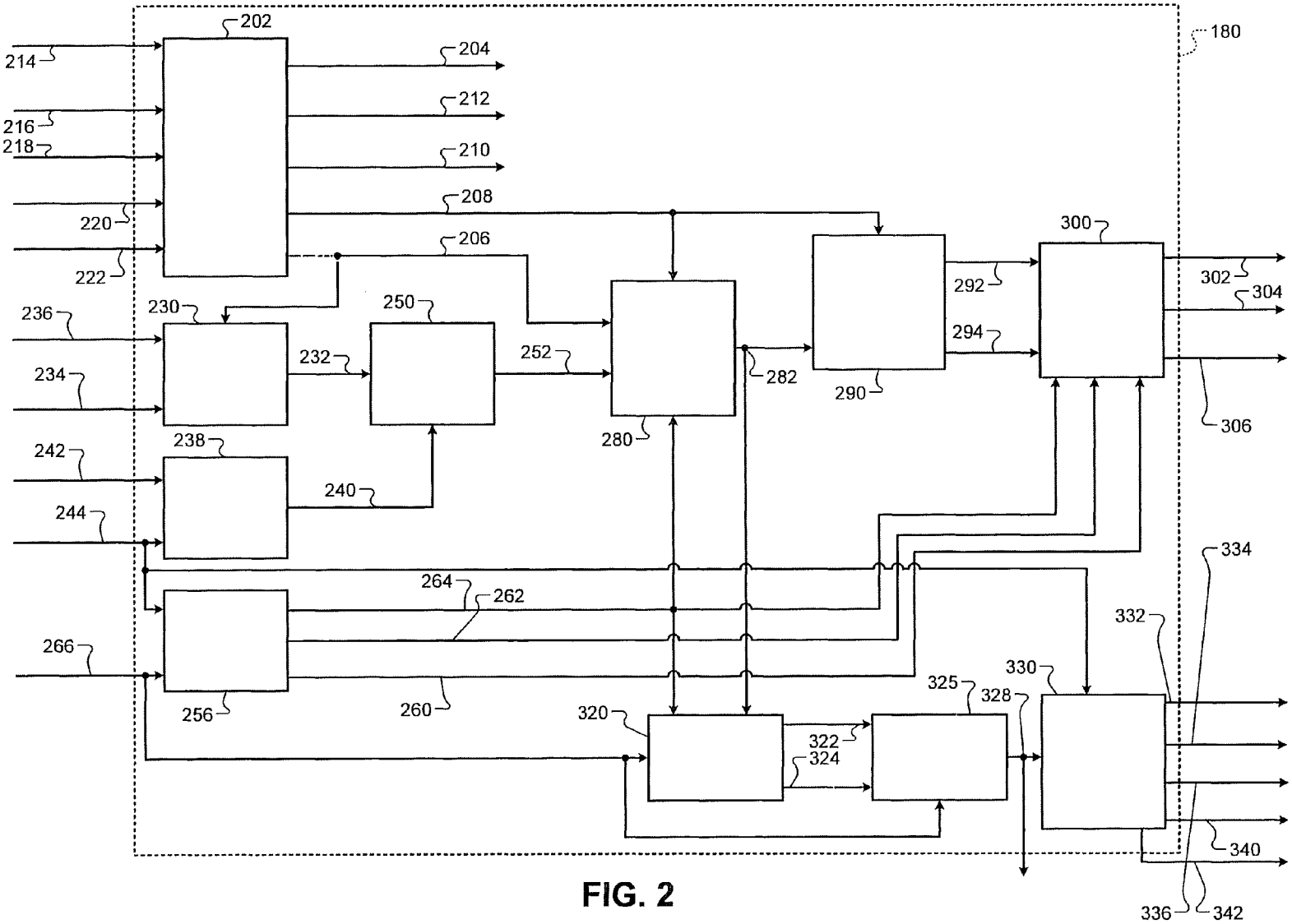
FIG. 2 is a functional block diagram of an example pressure parameter correction module according to the present disclosure.

Referring now to FIG. 2, a functional block diagram of an example implementation of the pressure parameter correction module 180 is presented. An expected mean effective pressure (MEP) module 202 generates expected MEPs for the cylinder 114 for each combustion cycle of the cylinder 114. For example only, the expected MEPs for a given combustion cycle may include an expected indicated mean effective pressure (IMEP) 204, an expected brake mean effective pressure (BMEP) 206, an expected net mean effective pressure (NMEP) 208, an expected pumping mean effective pressure (PMEP) 210, and an expected friction mean effective pressure (FMEP) 212.

The expected MEP module 202 may generate the expected MEPs for a given combustion cycle of the cylinder 114 based on at least one of: an expected brake torque 214 for the combustion cycle, expected friction torque losses 216 for the combustion cycle, an engine vacuum 218 for the combustion cycle, an intake camshaft position 220, and an exhaust camshaft position 222. Additionally or alternatively, the expected MEP module 202 may generate the expected MEPs for the given combustion cycle based on one or more of the other expected MEPs for the given combustion cycle.

A brake torque, such as the expected brake torque 214, may correspond to a torque about the crankshaft including losses and loads on the engine 102. The losses may include, for example, frictional losses, engine pumping losses, and/or one or more other sources of torque loss. The loads may include, for example, loads imposed on the crankshaft by accessories and/or one or more other loads on the crankshaft. The expected friction losses 216 may be estimated based on one or more parameters, such as engine oil temperature, coolant temperature, and/or one or more other suitable parameters. The expected brake torque 214 and the expected friction losses 216 may be used to generate an expected indicated torque for the given combustion cycle. An indicated torque corresponds to torque about the crankshaft attributable to combustion. In contrast with a brake torque, an indicated torque does not account for the losses and loads on the engine 102. The engine vacuum 218 may be measured or determined based on the MAP and ambient or barometric air pressure in various implementations. The intake and/or exhaust camshaft positions 220 and 222 may be measured or determined based on one or more other measured parameters (e.g., crankshaft position) in various implementations.

An IMEP for a given combustion cycle may be a calculated value of the MEP within the cylinder 114 attributable to combustion without the losses and/or loads. In contrast with an IMEP, a BMEP may be based on a measured MEP taken with the losses and loads on the engine 102. For example only, measured BMEPs may be measured under various operating conditions using a dynamometer and used to generate a relationship (e.g., a function or a mapping) between the operating conditions and the measured BMEP. During engine operation, the measured BMEP for a given combustion cycle can be generated (e.g., by the ECM 110) based on the operating conditions for the given combustion cycle and the relationship. A PMEP may be a loss in IMEP associated with the pumping losses of the engine 102. A FMEP may be a loss in BMEP associated with the frictional losses. For example only, a BMEP may be equal to a NMEP minus a FMEP, and an IMEP may be equal to an NMEP minus a PMEP, where the FMEP is a negative value and the PMEP is generally a negative value.

An expected delta speed module 230 generates an expected change in engine speed for the combustion cycle of the cylinder 114. The expected change in the engine speed is referred to as an expected delta engine speed 232. The expected delta speed module 230 generates the expected delta engine speed 232 for the combustion cycle based on a first engine speed 234, an estimated inertia 236 for the combustion cycle, and the expected BMEP 206 for the combustion cycle. The estimated inertia 236 may correspond to an estimated inertia of the drivetrain. For example only, the first engine speed 234 may be determined based on a period between two pulses in the crankshaft position signal 146 where the pulses correspond to two teeth of the N-toothed wheel that are separated by at least the rotational distance between firing events in degrees (°) of crankshaft rotation.

A measured delta speed module 238 generates a measured change in the engine speed for the combustion cycle of the cylinder 114. The measured change in the engine speed is referred to as a measured delta engine speed 240. The measured delta speed module 238 may generate the measured delta engine speed 240 based on a second engine speed 242 and a crankshaft position 244. The crankshaft position 244 may be generated by tracking (e.g., counting) the pulses in the crankshaft position signal 146. The second engine speed 242 may be determined based on a period between two pulses in the crankshaft position signal 146 where the pulses correspond to two teeth of the N-toothed wheel that are separated by a smaller rotational distance than the first engine speed 234.

An error module 250 determines a delta engine speed error 252 for the combustion cycle based on the expected delta engine speed 232 and the measured delta engine speed 240. The error module 250 may set the delta engine speed error 252 equal to a difference between the expected and measured delta engine speeds 232 and 240.

A measured MEP module 256 generates measured MEPs for the combustion cycle of the cylinder 114. The measured MEPs may include a measured IMEP 260, a measured PMEP 262, and a measured NMEP 264. For example only, the measured MEP module 256 may generate the measured MEPs based on the crankshaft position 244 and a cylinder pressure 266. Additionally or alternatively, the measured MEP module 256 may generate a measured MEP based on one or more of the other measured MEPs. The cylinder pressure 266 may be generated based on the cylinder pressure signal 154. For example only, the cylinder pressure 266 may be set equal to or based on the cylinder pressure signal 154 at each pulse in the crankshaft position signal 146. Between consecutive pulses in the crankshaft position signal 146, the cylinder pressure 266 may be estimated for each predetermined amount of crankshaft rotation (e.g.,1°).

An NMEP error module 280 generates an NMEP error 282 for the combustion cycle. The NMEP error module 280 may generate the NMEP error 282 based on the measured NMEP 264, the expected NMEP 208, the expected BMEP 206, and the delta engine speed error 252. For example only, the NMEP error module 280 may determine an initial NMEP error based on a difference between the expected and measured NMEPs 208 and 264 and adjust the initial NMEP error based on the delta engine speed error 252 and the expected BMEP 206 to produce the NMEP error 282.

A first correction determination module 290 generates a first offset correction 292 and a first slope correction 294 for the combustion cycle based on the NMEP error 282 and the expected NMEP 208. The first correction determination module 290 generates the first offset correction 292 and the first slope correction 294 further based on one or more previous values of the NMEP error 282 and the expected NMEP 208 for previous combustion cycles, respectively. For example only, the first correction determination module 290 may generate the first offset correction 292 and the first slope correction 294 using one or more linear prediction relationships, such as an adaptive filter, recursive least squares (RLS), least mean squares (LMS), neural network, and/or other suitable relationships.

A MEP correction module 300 generates corrected MEPs for the combustion cycle of the cylinder 114. The corrected MEPs may include a corrected NMEP 302, a corrected IMEP 304, and a corrected PMEP 306. The MEP correction module 300 generates the corrected MEPs based on the measured MEPs, respectively, and based on the first offset and slope corrections 292 and 294. For example only, the MEP module correction 300 may generate the corrected MEPs using the equations:

Corrected NMEP=(Measured NMEP+Offset)*Slope;

Corrected IMEP=(Measured IMEP+Offset)*Slope;
and

Corrected PMEP=(Measured PMEP+Offset)*Slope, where Corrected NMEP is the corrected NMEP 302, Corrected IMEP is the corrected IMEP 304, Corrected PMEP is the corrected PMEP 306, Measured NMEP is the measured NMEP 264, Measured IMEP is the measured IMEP 260, Measured PMEP is the measured PMEP 262, Offset is the first offset correction 292, and Slope is the first slope correction 294. In various implementations, the first offset correction 292 may be a positive or negative real number, and the first slope correction 294 may be a positive real number with a nominal value of approximately 1. One or more engine operating parameters may be controlled (e.g., by the actuator control module 190) based on the corrected NMEP 302, the corrected IMEP 304, and/or the corrected PMEP 306, such as fuel injection timing, spark timing, air flow, and/or one or more other suitable engine operating parameters.

A second correction determination module 320 generates a second offset correction 322 and a second slope correction 324 for the combustion cycle of the cylinder 114 based on the measured NMEP 264, the NMEP error 282, and the cylinder pressure 266. The second correction determination module 320 generates the second offset correction 322 and the second slope correction 324 further based on one or more previous values of the measured NMEP 264, the NMEP error 282, and the cylinder pressure 266 for previous combustion cycles, respectively. For example only, the second correction determination module 320 may generate the second offset correction 322 and the second slope correction 324 using one or more linear prediction relationships, such as an adaptive filter, RLS, LMS, neural network, and/or other suitable relationships.

A cylinder pressure correction module 325 generates a corrected cylinder pressure 328 for the combustion cycle. The cylinder pressure correction module 325 generates the corrected cylinder pressure 328 based on the cylinder pressure 266 and the second offset and slope corrections 322 and 324. For example only, the cylinder pressure correction module 325 may generate the corrected cylinder pressure 328 using the equation:

Corrected CyIP=(CyIP+Offset)*Slope, where Corrected CyIP is the corrected cylinder pressure 328, CyIP is the cylinder pressure 266, Offset is the second offset correction 322, and Slope is the second slope correction 324. In various implementations, the second offset correction 322 may be a positive or negative real number, and the second slope correction 324 may be a positive real number with a nominal value of approximately 1.

A variable correction module 330 generates corrected variable values for the combustion cycle. The variable correction module 330 generates the corrected variable values for the combustion cycle based on the corrected cylinder pressure 328 and the crankshaft position 244. The corrected variable values may include a second corrected NMEP 332, a second corrected IMEP 334, and a second corrected PMEP 336, a corrected crankshaft angle value at which 50 percent of injected fuel is burned (CA50) 340, a corrected ringing index (RI) 342, and/or one or more other corrected values. One or more engine operating parameters may be controlled (e.g., by the actuator control module 190) based on the second corrected NMEP 332, the second corrected IMEP 334, the second corrected PMEP 336, the corrected CA50 340, and/or the corrected RI 342, such as fuel injection timing, spark timing, air flow, and/or one or more other suitable engine operating parameters.

Figure 3:
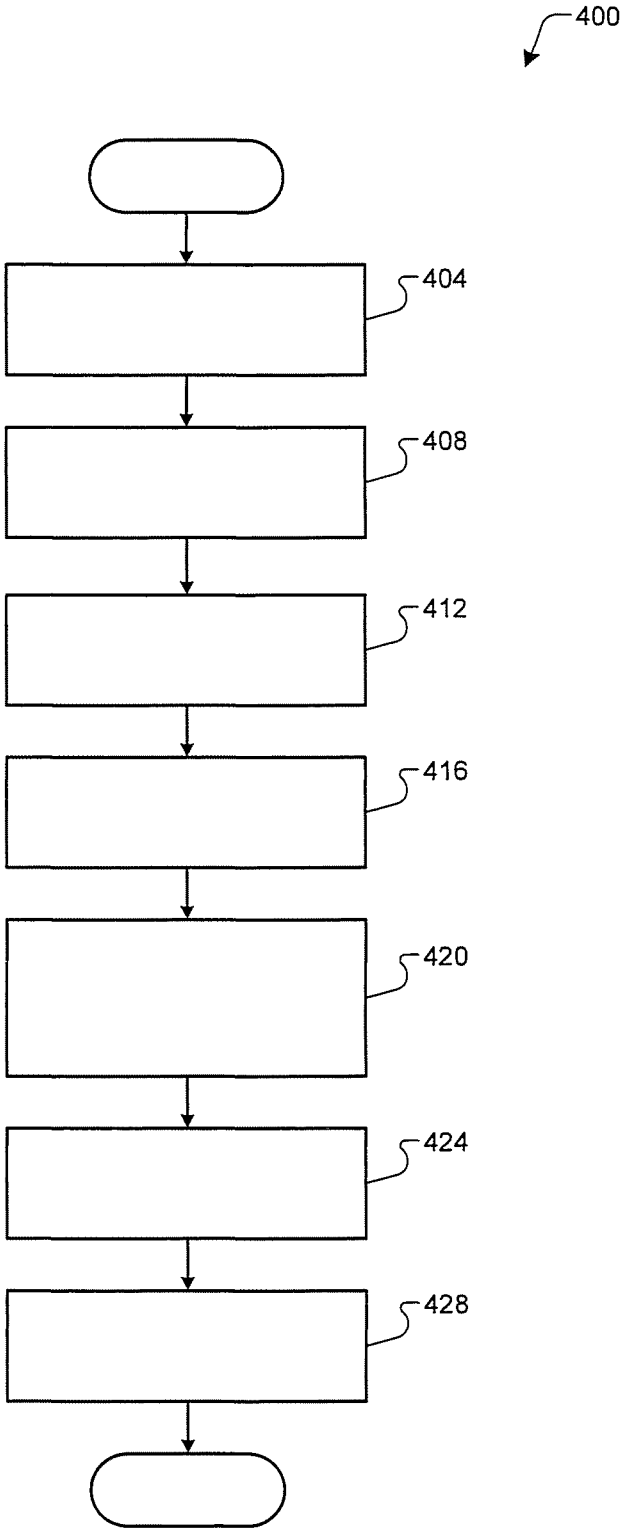
FIG. 3 is a functional block diagram of an example method of correcting various cylinder pressure related parameters according to the present disclosure.

Referring now to FIG. 3, a flowchart depicting an example method 400 of generating corrected cylinder pressure related parameters and controlling engine operation is presented. Control begins at 404 where control generates the expected and measured MEPs for a combustion cycle of the cylinder 114. More specifically, control generates the expected IMEP 204, the expected BMEP 206, the expected NMEP 208, the expected PMEP 210, the expected FMEP 212, the measured IMEP 260, the measured PMEP 262, and the measured NMEP 264.

Control generates the expected and measured delta engine speeds 232 and 240 for the combustion cycle of the cylinder 114 at 408. Control may generate the expected delta engine speed 232 based on the estimated inertia 236 and the first engine speed 234. Control may generate the measured delta engine speed 240 based on the second engine speed 242 and the crankshaft position 244.

Control generates the delta engine speed error 252 for the combustion cycle of the cylinder 114 based on the expected and measured delta engine speeds 232 and 240 at 412. Control generates the delta engine speed error 252 based on a difference between the expected and measured delta engine speeds 232 and 240. Control generates the NMEP error 282 for the combustion cycle of the cylinder 114 at 416. Control may generate the NMEP error 282 based on the expected BMEP 206, the expected NMEP 208, the measured NMEP 264, and the delta engine speed error 252.

Control generates the first offset correction 292 and the first slope correction 294 at 420. Control generates the first offset correction 292 and the first slope correction 294 based on the measured NMEP 264, the NMEP error 282, and the expected NMEP 208. Control also generates the second offset correction 322 and the second slope correction 324 at 420. Control generates the second offset correction 322 and the second slope correction 324 based on the NMEP error 282 and the cylinder pressure 266.

Control generates the corrected MEPs for the combustion cycle of the cylinder 114 at 424. More specifically, control generates the corrected NMEP 302, the corrected IMEP 304, and the corrected PMEP 306. Control generates the corrected MEPs based on the measured MEPs, respectively, and based on the first offset correction 292 and the first slope correction 294.

Control also generates the corrected cylinder pressure 328 at 424. Control generates the corrected cylinder pressure 328 based on the cylinder pressure 266 and the second offset and slope corrections 322 and 324. Control also generates the second corrected MEPs and the corrected variable values at 424. More specifically, control generates the second corrected NMEP 332, the second corrected IMEP 334, the second corrected PMEP 336, the corrected CA50 340, the corrected RI 342, and/or one or more other values at 424. Control generates the second corrected NMEP 332, the second corrected IMEP 334, the second corrected PMEP 336, the corrected CA50 340, and the corrected RI 342 based on the corrected cylinder pressure 328 and the crankshaft position 244.

Control regulates one or more engine operating parameters at 428. Control may regulate or adjust one or more engine operating parameters based on the corrected NMEP 302, the corrected IMEP 304, the corrected PMEP 306, the corrected cylinder pressure 328, the second corrected NMEP 332, the second corrected IMEP 334, the second corrected PMEP 336, the corrected CA50 340, and/or the corrected RI 342. While control is illustrated as ending after 428, the method 400 may be illustrative of one control loop, and control may return to 404.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

a net mean effective pressure (NMEP) error module that determines an NMEP error for a combustion cycle of a cylinder based on an expected NMEP for the combustion cycle, a measured NMEP for the combustion cycle, and a difference between an expected change in an engine speed for the combustion cycle and a measured change in the engine speed for the combustion cycle;

a correction determination module that determines an offset correction and a slope correction based on the NMEP error;

a mean effective pressure (MEP) correction module that generates a corrected NMEP for the combustion cycle based on the measured NMEP, the offset correction, and the slope correction; and an actuator control module that controls an engine operating parameter based on the corrected NMEP.

2. The system of claim 1 wherein the MEP correction module sets the corrected NMEP equal to a product of the slope correction and a sum of the measured NMEP and the offset correction.

3. The system of claim 1 further comprising a measured MEP module that generates a measured indicated mean effective pressure (IMEP) for the combustion cycle and a pumping loss in the measured IMEP for the combustion cycle, wherein the MEP correction module further generates a corrected IMEP for the combustion cycle based on the measured IMEP, the offset correction, and the slope correction, and wherein the MEP correction module further generates a corrected pumping loss in the measured IMEP for the combustion cycle based on the measured IMEP, the offset correction, and the slope correction.

4. The system of claim 1 further comprising:

a second correction determination module that determines a second offset correction and a second slope correction based on the NMEP error; and a cylinder pressure correction module that generates a corrected cylinder pressure based on a measured cylinder pressure, the second offset correction, and the second slope correction.

5. The system of claim 4 further comprising a variable correction module that generates a corrected value of a crankshaft angle where a predetermined percentage of fuel was combusted within the cylinder during the combustion cycle based on the corrected cylinder pressure.

6. The system of claim 4 further comprising a variable correction module that generates a corrected ringing index (RI) for the combustion cycle based on the corrected cylinder pressure.

7. The system of claim 4 wherein the second correction determination module determines the second offset correction and the second slope correction further based on the measured cylinder pressure.

8. The system of claim 1 wherein the correction determination module determines the offset correction and the slope correction further based on the expected NMEP.

9. The system of claim 1 further comprising an expected mean effective pressure (MEP) module that generates an expected brake mean effective pressure (BMEP) for the combustion cycle, wherein the NMEP error module determines the NMEP error further based on the expected BMEP.

10. The system of claim 1 further comprising a measured MEP module that determines the measured NMEP based on a cylinder pressure and a crankshaft position.

11. A method comprising:

using a net mean effective pressure (NMEP) error module, determining an (NMEP) error for a combustion cycle of a cylinder based on an expected NMEP for the combustion cycle, a measured NMEP for the combustion cycle, and a difference between an expected change in an engine speed for the combustion cycle and a measured change in the engine speed for the combustion cycle;

using a correction determination module, determining an offset correction and a slope correction based on the NMEP error;

using a mean effective pressure (MEP) correction module, generating a corrected NMEP for the combustion cycle based on the measured NMEP, the offset correction, and the slope correction; and using an actuator control module, controlling an engine operating parameter based on the corrected NMEP.

12. The method of claim 11 further comprising, using the MEP correction module, setting the corrected NMEP equal to a product of the slope correction and a sum of the measured NMEP and the offset correction.

13. The method of claim 11 further comprising:

using a measured MEP module, generating a measured indicated mean effective pressure (IMEP) for the combustion cycle and a pumping loss in the measured IMEP for the combustion cycle;

using the MEP correction module, generating a corrected IMEP for the combustion cycle based on the measured IMEP, the offset correction, and the slope correction; and using the MEP correction module, generating a corrected pumping loss in the measured IMEP for the combustion cycle based on the measured IMEP, the offset correction, and the slope correction.

14. The method of claim 11 further comprising:

using a second correction determination module, determining a second offset correction and a second slope correction based on the NMEP error; and using a cylinder pressure correction module, generating a corrected cylinder pressure based on a measured cylinder pressure, the second offset correction, and the second slope correction.

15. The method of claim 14 further comprising, using a variable correction module, generating a corrected value of a crankshaft angle where a predetermined percentage of fuel was combusted within the cylinder during the combustion cycle based on the corrected cylinder pressure.

16. The method of claim 14 further comprising, using a variable correction module, generating a corrected ringing index (RI) for the combustion cycle based on the corrected cylinder pressure.

17. The method of claim 14 further comprising, using the second correction determination module, determining the second offset correction and the second slope correction further based on the measured cylinder pressure.

18. The method of claim 11 further comprising, using the correction determination module, determining the offset correction and the slope correction further based on the expected NMEP.

19. The method of claim 11 further comprising:

using an expected MEP module, generating an expected brake mean effective pressure (BMEP) for the combustion cycle; and using the NMEP error module, determining the NMEP error further based on the expected BMEP.

20. The method of claim 11 further comprising, using a measured MEP module, determining the measured NMEP based on a cylinder pressure and a crankshaft position.

* * * * *

UNITED STATES PATENT AND TRADEMARK OFFICE

CERTIFICATE OF CORRECTION

PATENT NO. : 9,115,655 B2
APPLICATION NO. : 13/094273
DATED : August 25, 2015
INVENTOR(S) : Rayl It is certified that error appears in the above-identified patent and that said Letters Patent is hereby corrected as shown below:

Title Page, Item [73], insert
--GM Global Technology Operations LLC, Detroit, MI (US)--

Signed and Sealed this
Twenty-fourth Day of May, 2016

Michelle K. Lee

Michelle K. Lee
*Director of the United States Patent and Trademark Office*